US005720483A

United States Patent [19]

Trinh

[11] Patent Number: 5,720,483

[45] Date of Patent: Feb. 24, 1998

[54] NON-BANKING PAYOFF SYSTEM

[75] Inventor: Hai-Bang D. Trinh, 7105 Brentwood La., Westminster, Calif. 92683

[73] Assignee: Hai-Bang D. Trinh, Westminster, Calif.

[21] Appl. No.: 638,938

[22] Filed: Apr. 25, 1996

[51] Int. Cl.[6] ..... A63F 1/00

[52] U.S. Cl. ..... 273/292; 273/274

[58] Field of Search ..... 273/292, 274, 273/309

[56] References Cited

U.S. PATENT DOCUMENTS

| | | | |
|---|---|---|---|
| 5,226,661 | 7/1993 | Wolf | 273/292 |
| 5,249,809 | 10/1993 | Wolf | 273/292 |
| 5,452,900 | 9/1995 | Skratulia et al. | 273/292 |

*Primary Examiner*—Benjamin H. Layno

[57] ABSTRACT

A non-banking gambling method for use with conventional gambling games such as card games wherein each player risks only the amount such player wagers and wherein each player plays against other players and wins or loses according the player's collection of cards or other gambling devices regardless of the amount wagered.

11 Claims, 8 Drawing Sheets

NON-BANKING PAYOFF SYSTEM

BACKGROUND OF THE INVENTION

1. Field of the Invention

For many years the banking pay-off system, has been used in casinos through out the country, which applies to card games, such as Blackjack (21), Domino (Chinese tiles), Asian poker, Baccarat, and other type of gambling games with same type of banking pay-off system. All of the aforementioned games use gambling devices, e.g. cards, and are of the type wherein different collections of such devices are ranked by the rules of such game as to winning or losing and wherein the respective players place wagers and the respective players win or lose according to the ranking of their respective collections of gambling devices.

A Banking pay-off system means, that all players place bets at the table against the casino (similar to Las Vegas 21 Blackjack), or one to seven players place bets against one of the player/banker (similar to casino in California).

Through out the years, card gambling has been legal in many States, such as Arizona, California, Washington, Iowa, and others. But there are some restrictions, that apply to different States. For example, California and Washington, allow banking pay-off system, while States such as Arizona, do not allow any type of card games or games that use banking pay-off method. Therefore, the Nonbanking Pay-Off System was invented, to meet the legal requirements in those States.

A Nonbanking Pay-Off System means, the gaming operation does not participate in, or have any interest in, the outcome of the game. Only players play against one another. The gaming operation makes money by charging the players in rates per hour, or per hand that players play.

2. Prior Art

Over the years, some card games have been invented, such as "Method of playing a blackjack type card game" (U.S. Pat. No. 5,413,353) and "Method and apparatus of playing a casino game simultaneously against the dealer and other players" (U.S. Pat. No. 5,395,120), also "California Blackjack" (U.S. Pat. No. 5,275,415).

Whatever method and apparatus or new type of card playing game of the above cited references, none of them achieves or fulfills the purpose of single/variable bets, which will allow high and low limit players at the same table.

SUMMARY OF THE INVENTION

The Nonbanking Pay-Off System has two principal objectives:

The first objective is to provide players with a freedom of betting. They will now be free to bet any amount they desire, instead of, having to place an identical wager, or an assigned limit.

The second objective is to revolutionize the casino gaming industry with a conceptually new pay-off system.

A further benefit is to have gaming operation that is risk free in losing big money to players who cheat at the game, because no player ever makes any bet against the gaming operation.

Accordingly, the Nonbanking Pay-Off System is fully capable in replacing any existing card gaming game currently using in the Banking pay-off system.

DETAILED DESCRIPTION

The Nonbanking Pay-Off System was developed to be suitable to play with any type of existing banking game. It is capable of replacing any games with banking pay off system. It is the combination of Banking and Pot winning system. Therefore, the casino does not participate in the actual play of the game, and has no interest in the outcome of play, and no player ever plays against, or makes a wager against the casino. Only players play against one another.

After years of experience in the casino gaming industry, I derived three (3) different types of Nonbanking Single/Variable betting systems, which I called:

1. Best of all system.
2. Step by step system.
3. Better and better system.

With Nonbanking Single/Variable means:

Nonbanking: There is no banker/player in this type of system. Therefore, no player has a mathematical percentage advantage over the other players, and the gaming operation does not participate in, or have any interest in the outcome of the game.

Single Variable: Which means that players are able to bet any amount on his/her spot. With this option, it capable to combine high limit and low limit players at the same game.

For the best explanation of each system, I have provided some examples of the outcome of the game on the next few pages.

BEST OF ALL SYSTEM

This type of pay-off system is very straight forward. Whoever has the best hand out of all the players, will collect the losing wagers from each player up to whatever the winning amount is, or 2 or more players with the best ranking hand, will split the pot among themselves. The foregoing sequence of play is depicted in the flow chart 9 (FIG. 1), through Step 21. As described, at the start of the game, identified at Step 10, the players place wagers, Step 11. The dealer checks to assure that wagers are within the table limit, Step 12, and corrects the wager(s) if necessary, step 13. The dealer then deals out the hands, Step 14, and the players play their hands, Step 15. The dealer determines the highest hand(s) among players, Step 16, and the player's pay-off as determined by the dealer, Step 17. The dealer checks to assure that there is no losing wager(s) remain, Step 18, if no losing wagers remain, the hand ends, Step 20, and the play returns to start, Step 21, for a new game, beginning again with Step 10. If losing wager(s) still remain, Step 18, the dealer returns remaining losing wager(s) to the respective losing player(s), Step 19, then the hand ends, Step 20, and the play returns to start, Step 21, for a new game, beginning again with Step 10.

Figure 1:
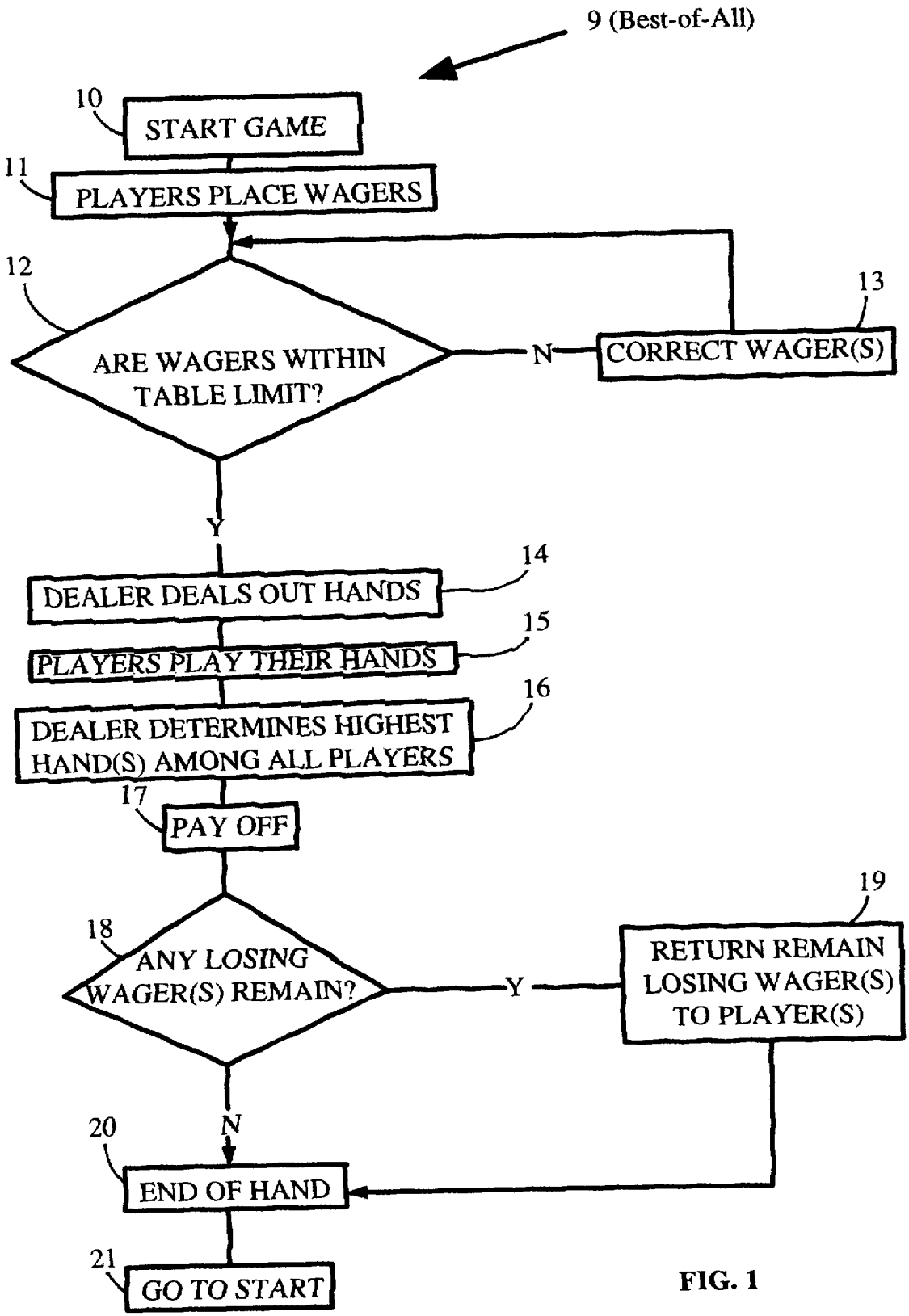
FIG. 1 show a flow chart that depicts the steps in playing the basic "Best-of-All" pay-off system.
Figure 2:
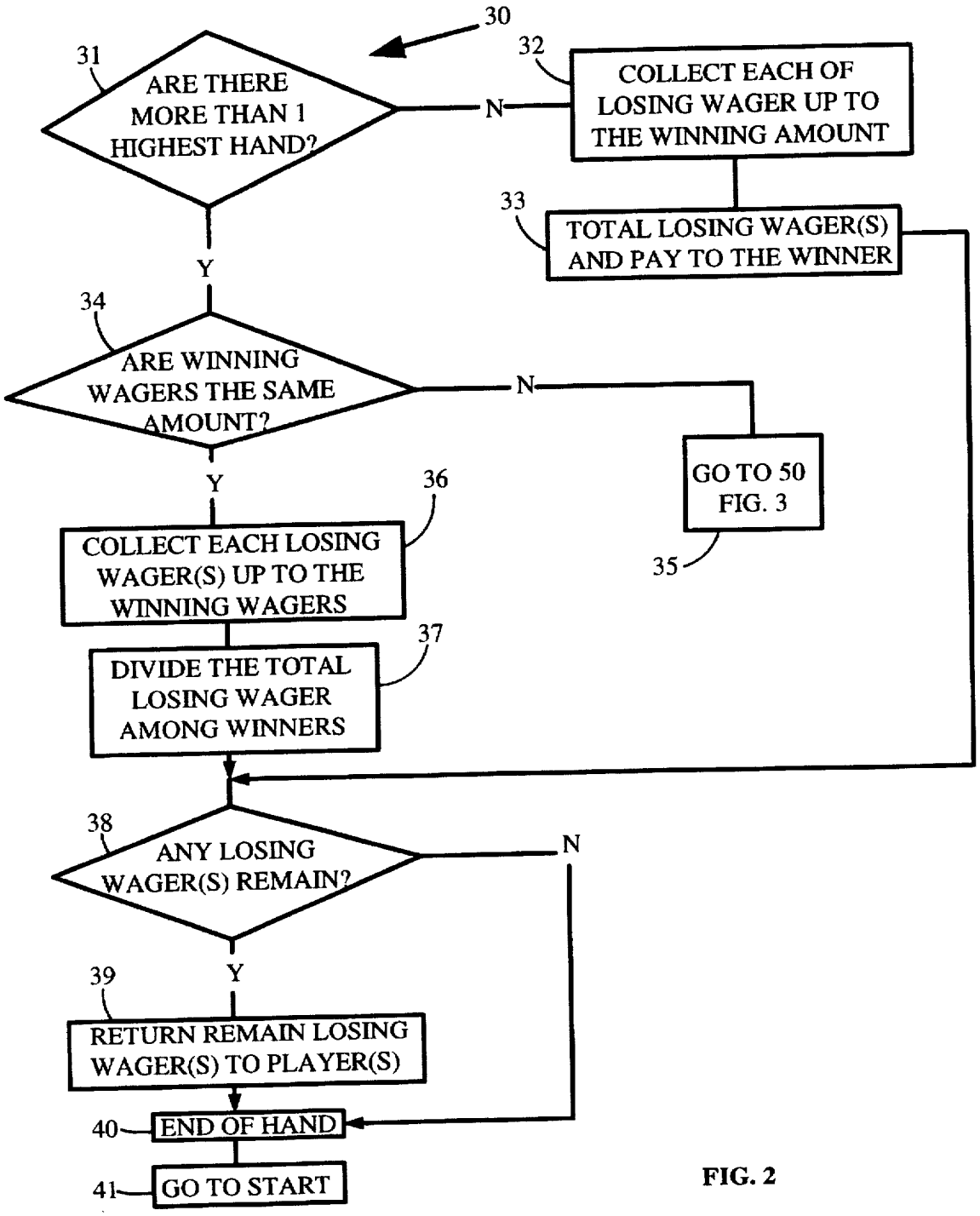
FIG. 2 show a flow chart that depicts in more detail of the pay-off Step 17 (FIG. 1) handling the contingency of there being one or more than one highest hand.

FIG. 2, show a flow chart 30, which is equivalent to Step 17 in FIG. 1, omitting earlier steps, depicting in more detail of the pay-off handling the contingency of there being one or more than one highest hand.

Referring to flow chart 30 (FIG. 2). If the dealer determines that there is only one highest hand, as shown in Step 31, the dealer collects from the losing players an amount up to the amount of the winning wager, limited as previously explained by the amount of the losing wager, as shown in Step 32, and pay the total of the losing wagers to the winner, Step 33. The dealer checks to assure that there is no losing wager(s) remain, Step 38, if no losing wager(s) remain, the hand ends, Step 40, and the play returns to start, Step 41, for a new game, beginning a gain with Step 10 (FIG. 1). If losing wager(s) still remain, the dealer returns wager(s) to player(s), Step 39, then the hand ends, Step 40, and the play returns to start, Step 41, for a new game, beginning again with Step 10 (FIG. 1).

Returning to Step 31 (FIG. 2). If the dealer determines that there are two or more highest hands among players, and that the winning wagers are of the same amount, Step 34, the dealer collects, from the losing players the amount up to the winning wagers or the amount wagered by respective losing player, Step 36. Thereafter the total of the losing wager(s) collected are divided among the winners, Step 37. The dealer then determines if there is any losing wager(s) remain, Step 38, if no losing wager(s) remain, the hand ends, Step 40, and the play returns to start, Step 41, for a new game, beginning again with Step 10 (FIG. 1). If losing wager(s) still remain, the dealer returns remaining losing wager(s) to the respective losing player(s), Step 39, then the hand ends, Step 40, and the play returns to start, Step 41, for a new game, beginning again with Step 10 (FIG. 1).

Figure 3:
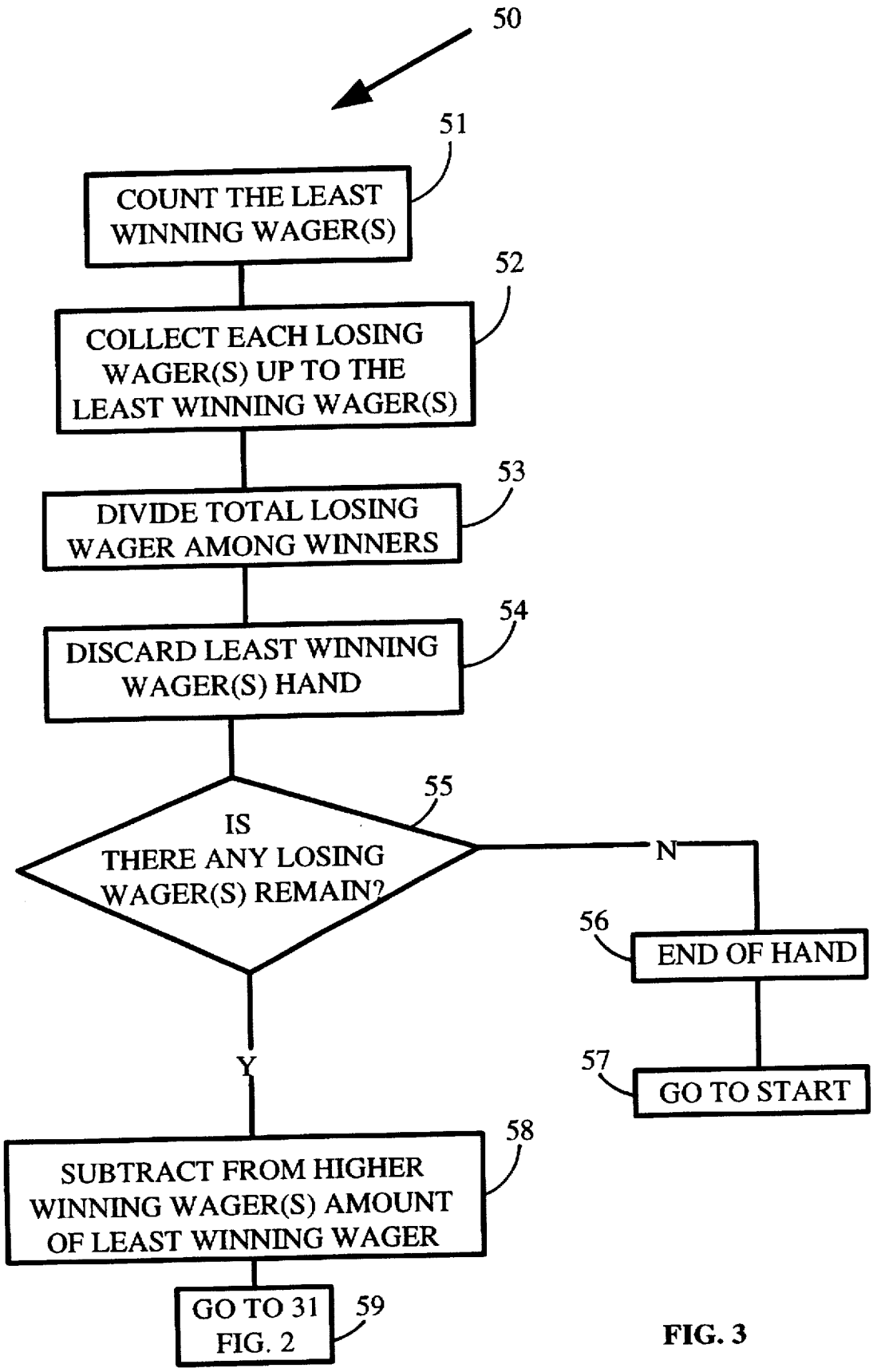
FIG. 3 show a flow chart that depicts in more detail of the pay-off Step 17 (FIG. 1) handling the contingency of there being more than one highest hand with different amount of wager.

Returning to Step 34 (FIG. 2). If the dealer determines that there are two or more winners and that the amount wagered by the winners are not in the same amount, then the pay-off continues as shown in Step 35, go to flow chart 50 (FIG. 3). The dealer then counts the least winning wagers, Step 51, and collects from each losing wager the amount up to the amount of the least winning wager(s) or the amount wagered by respective losing player, Step 52. The total of the losing wager(s) are divided among the winners, Step 53, and the hand(s) of least winning wager are discarded, Step 54. The dealer then determines if there are any losing wager(s) remaining, Step 55. If there are none, that is the end of the hand, Step 56, and the play returns to the start, shown in Step 57, and a new game begins, Step 10 (FIG. 1). If the dealer determines that there are losing wager(s) remain, Step 55, then the dealer subtracts from the higher winning wager(s) the amount of the least winning wager, as this was previously paid, Step 58, and the play returns to Step 31 (FIG. 2) to continue the pay-off, as shown at Step 59.

For example:

| PLAYERS | BETTING AMOUNT |
|---|---|
| #1 | $15 |
| #2 | $45 |
| #3 | $25 |
| #4 | $10 |
| #5 | $20 |
| #6 | $60 |
| #7 | $95 |
| #8 | $30 |

If player #4 has the best hand, then he will only collect $10 from each player, therefore he will win a total of $70, and the difference will be returned to the players.

If player #8 has the best hand, then he will collect

| | |
|---|---|
| $15 | from player #1 |
| $30 | from player #2 with a change of $15 |
| $25 | from player #3 |
| $10 | from player #4 |
| $20 | from player #5 |
| $39 | from player #6 with a change of $30 |
| $30 | from player #7 with a change of $65 |

Therefore, player #8 has total winning of $160.

If player #7 has the best hand, then he will collect all wagers from each player, because he has the highest wager in the game.

If player #4 and player #8 have the same best ranking hand, then they collect as:

| | |
|---|---|
| $10 | from player #1 with $5 left over |
| $10 | from player #2 with $35 left over |
| $10 | from player #3 with $15 left over |
| $10 | from player #5 with $10 left over |
| $10 | from player #6 with $50 left over |
| $10 | from player #7 with $85 left over |

With a total of $60, the winning is divides by 2. Therefore, player #4 will receive $30, and player #8 will also receive $30. Player #8 just had only $10 in action, therefore, he still has $20 ($30–$10=$20) in action with other players, which he will continues to collect as:

| | |
|---|---|
| $5 | from player #1 |
| $20 | from player #2 with a change of $15 |
| $15 | from player #3 |
| $10 | from player #5 |
| $20 | from player #6 with a change of $30 |
| $20 | from player #7 with a change of $65 |

Therefore, player #8 will receive an addition of $90.

Summarizing the above example, after the gambling devices, cards in this example, have been distributed, the winning and losing players are determined in accordance with the ranking of the respective collections of gambling devices, i.e. the hands of cards, of the respective players. As shown in the example, the winning player takes from each losing player an amount of such player's wager that equals the lesser of amount wagered by the winning player or the amount wagered by respective losing player. The steps in this Best-of-All version of the invention are shown in FIG. 1 (flow chart 9), FIG. 2 (flow chart 30), and FIG. 3 (flow chart 50).

STEP BY STEP SYSTEM

With this type of pay-off system, it takes the Best Of All System further. All players with 2nd and 3rd hand ranking or so on will have complete action with each other, instead of, stopping after the pay-off of the best ranking hand.

For example:

If player #4 has the best hand of all, player #1 has the 2nd best, player #7 has the 3rd best, then the pay-off would be: Player #4 will collect $10 from each player, which left over as below:

| | |
|---|---|
| $5 | left over from player #1 |
| $35 | left over from player #2 |
| $15 | left over from player #3 |
| $10 | left over from player #5 |
| $50 | left over from player #6 |
| $85 | left over from player #7 |
| $20 | left over from player #8 |

Using the Best Of All System we would have stopped play. For the Step By Step System we will go on to next step. That leaves player #1 with the best hand of all, therefore, we continue to pay-off as below:

With $5 left over, he then will collects $5 from each remaining player. Therefore, he will bring back a total of $30.

Now this leaves player #7 with the best hand among the remaining players, he will win all the left over wagers, because his bet is the highest in the game.

This system of pay-off will give players a chance of full action, but requires more of an experienced dealer to handle the job. Thus, the Step-by-Step version of the invention simply continues the Best-of-All system after having eliminated the winner in the best of all round of play. After eliminating the winning player from the best of all round from further play, the winning and losing players are again determined in accordance with the ranking of the respective collections of gambling devices of the respective remaining players. Repealing the previously outlined steps with respect to the remaining players, an amount is taken from each losing player amount equal to the lesser of the amount of wager remaining or the amount of the remaining wager the respective losing player. All such amounts are given to the winning player in this round of play.

Figure 4:
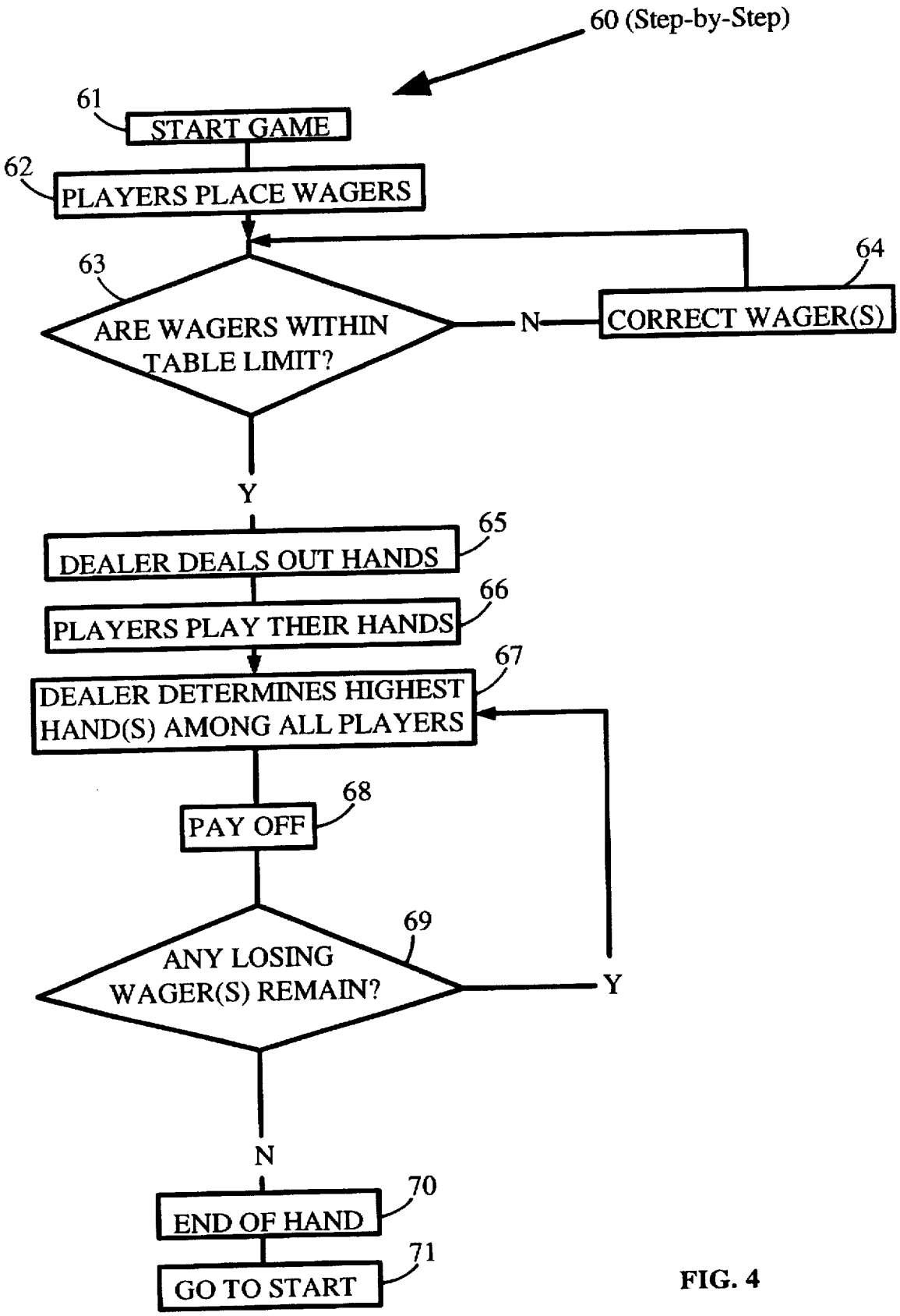
FIG. 4 show a flow chart that depicts the steps in playing the basic "Step-by-Step" pay-off system.

In its most basic sequence form, the Step-by-Step game is played as shown in FIG. 4 (flow chart 60). As described, at the start of the game, identified at Step 61, the players place wagers, Step 62. The dealer checks to assure that wagers are within the table limit, Step 63, and corrects the wager(s) if necessary, Step 64. The dealer then deals out the hands respectively by the rules of such game, Step 65, and the players play their hands respectively by the rules of such game, Step 66. The dealer determines the highest hand among the players, in accordance with the ranking of the respective game, Step 67, and the player's pay-off is determined by the dealer, Step 68. The dealer checks to see if there is any wagers remain, Step 69, if no wager(s) remain, the hand ends, Step 70, and the play returns to start, Step 71, for a new game, beginning again with Step 61. From the losing players, if there more wagers remaining, Step 69, then the play must returns to Step 67, as between the remaining players, dealer will determine highest hand(s) among them. The Steps 67, 68, and 69 repeat as long as there are still wagers remain.

Figure 5:
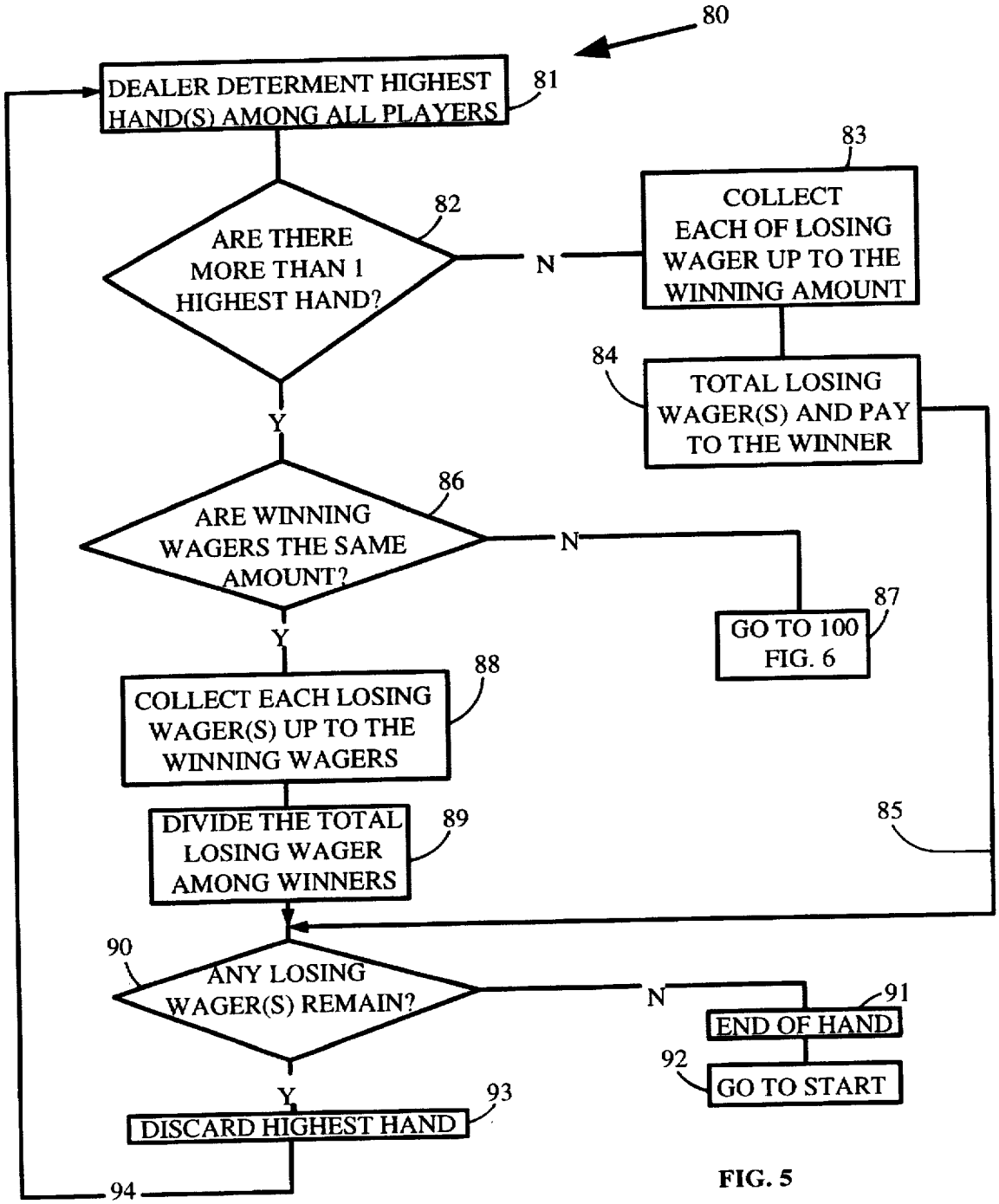
FIG. 5 show a flow chart that depicts in more detail of the pay-off Step 68 (FIG. 4) handling the contingency of there being one or more than one winners.

FIG. 5, show a flow chart 80, at Step 81 that is equivalent to Step 67 in FIG. 4, omitting earlier steps, depicting in more detail of the pay-off handling the contingency of there being one or more than one highest hand among the players. If the dealer determines that there is only one highest hand, as shown in Step 82, the dealer collects from the losing players an amount up to the amount of the winning wager, limited as previously explained by the amount of the losing wager, Step 83, and pays the total of the losing wagers to the winner, Step 84, and the play via by line 85, then the dealer checks for remaining wagers, Step 90, if no losing wager(s) remain, the hand ends, Step 91, and the play returns to start, Step 92, for a new game, beginning again with Step 61 (FIG. 4). If there are remaining losing wagers, the highest hand is discarded, Step 93, and plays returns to Step 81 and continues as to the remaining players, as shown by line 94.

Figure 6:
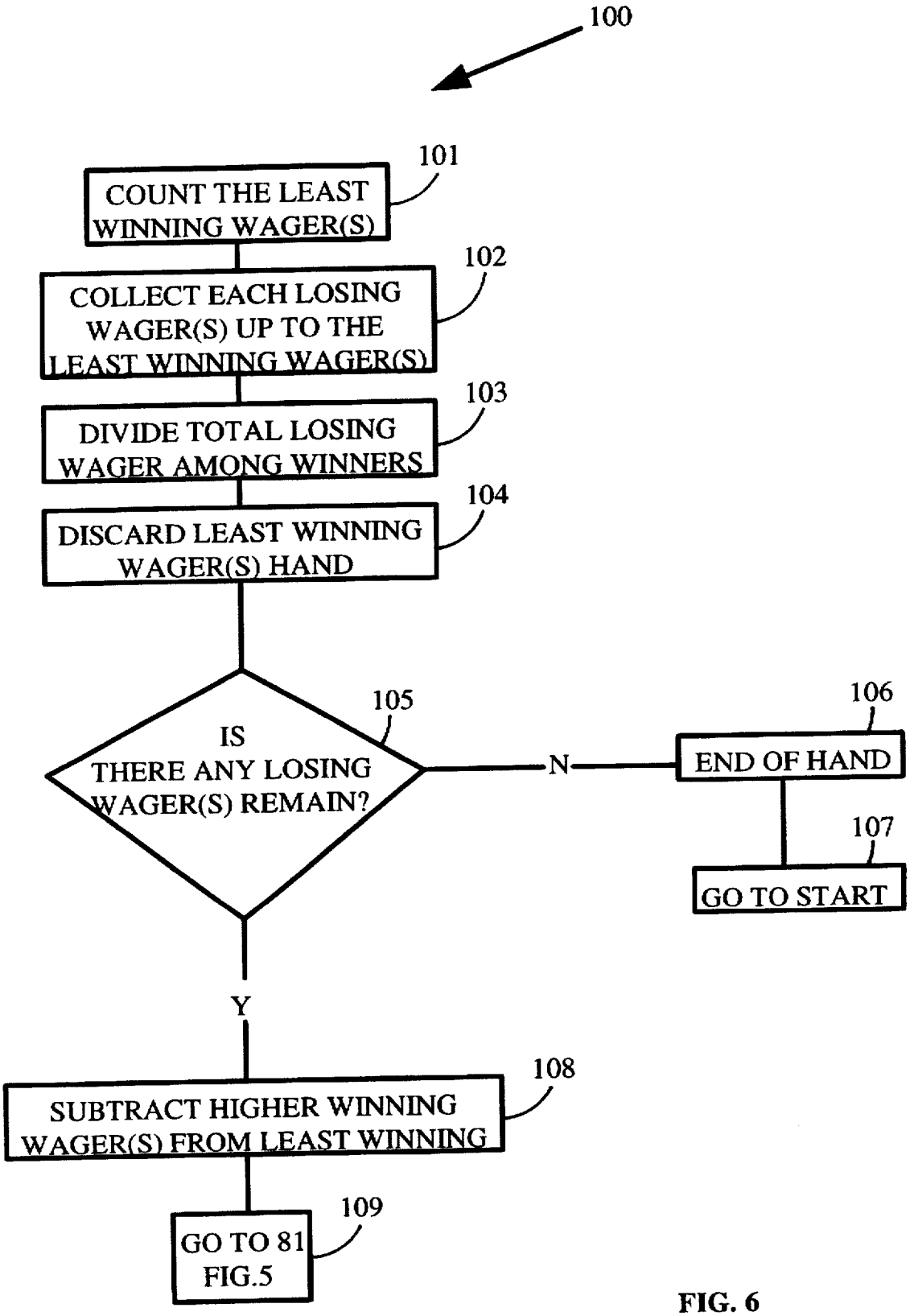
FIG. 6 show a flow chart that depicts in more detail of the pay-off Step 68 (FIG. 4) handling the contingency of there being more than one winners with different amount of wager.

If the dealer determines that there two or more winners and that the amount wagered by the winners are not in the same amount, Step 86, then the pay-off continues, as shown in Step 87, to flow chart 100 (FIG. 6). The dealer then counts the least winning wager, Step 101, and collects from each losing wager the amount up to the amount of the least winning wager(s), Step 102. The total of the losing wagers are divided among the winners, Step 103, and the least winning wager hand(s) discarded, Step 104. The dealer then determines if there are any losing wagers remaining, Step 105. If there are none, that is the end of the hand, Step 106, and the play returns to the start, shown in Step 107, and a new game begins. If the dealer determines that there are losing wagers remain, then the dealer subtracts from the higher winning wager(s) the amount of the least winning wager, Step 108, and return to Step 81 (FIG. 5) to continue the pay-off, as shown at Step 109.

Returning to Step 86 (FIG. 5). If the dealer determines that the winning wagers are of the same amount, then the dealer collects from each losing wager the mount up to and not exceeding the amount of the winning wagers, Step 88. The total of the losing wagers are divided equally among the winners, Step 89. The dealer then determines if there are any remaining losing wagers, Step 90. If there are no remaining losing wagers, then the game ends, Step 91, and the play returns to start, Step 92, for a new game, beginning again with Step 61 (FIG. 4). If there are wagers remaining from the losing players, then the dealer will discard the previously paid winning hands, Step 93, and the play returns to Step 81, as shown by line 94, and continue to pay-off as to the remaining players.

BETTER AND BETTER SYSTEM

This type of pay-off method will revolutionize the gaming industry. It will significantly increase casino revenues, by spreading out the win money among players on every hand. The Better and Better will make the game last longer. The longer time players spent in the game, the more increase casino revenues.

The hand with the action button, becomes the initial starting hand, by comparing it's ranking with the hand next to it in the clockwise manner. If the initial starting hand wins or push, it stays as a live hand, until it might or might not run into a better hand, then the better hand will take over, and become a live hand. This will repeat until we reach the last hand. Therefore, this method will generate more than one winner per hand. Whatever the players bet, that is all he/she can win up to from each player, or lose to a better hand.

For example:

Ranking from zero to nine points, zero as the worst, and nine as the best.

| PLAYERS | PLAYER'S HAND | BETTING AMOUNT |
|---|---|---|
| #1 | 2 points | $10 |
| #2 | 3 points | $25 |

-continued

| PLAYERS | PLAYER'S HAND | BETTING AMOUNT |
|---|---|---|
| #3 | 5 points | $45 |
| #4 | 8 points | $20 |
| #5 | 8 points | $60 |
| #6 | 0 points | $50 |
| #7 | 4 points | $15 |
| #8 | 9 points | $55 |

Figure 7:
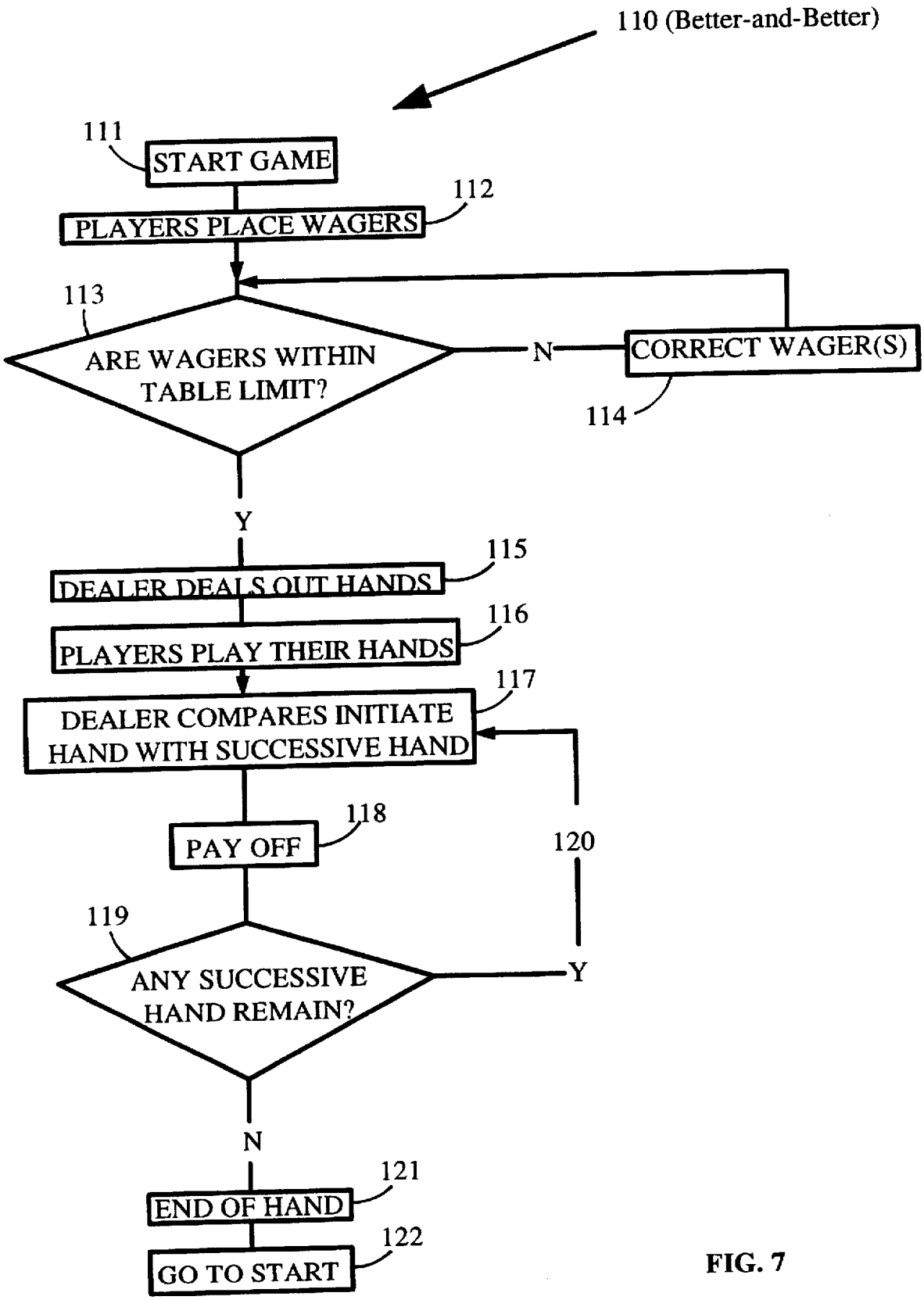
FIG. 7 show a flow chart that depicts the steps in playing the basic Better-and-Better pay-off system.

If the action button (indicate where to start) on player #3, then the pay-off show as below:

Player #3 loses only $20 to player #4, and is left with $25, which player #4 will become live hand, then compare to player #5, which will push, therefore no action was made, player #4 stays as live hand and go on to compare to player #6, then win $20, and win $15 only from player #7, then lose $20 to player #8, now player #8 will take over as a live hand, then go on win $10 from player #1, and $25 from player #2. The pay-off is now completed. The foregoing sequence of play for the Better-and-Better pay-off system is depicted in flow chart 110 (FIG. 7). As described, at the start of the game, identified at Step 111, the players place wagers, Step 112. The dealer checks to assure that wagers are within the table limit, Step 113, and corrects the wager(s) if necessary, Step 114. The dealer then deals out the hands to players in according with the game rules, Step 115, and the players play their hands, Step 116. The dealer determines win, lose, push, between the first initiating hand and the immediate successive hand, Step 117, then the pay-off is base on the result of Step 117, Step 118. The dealer then determines if there is any successive hand remaining for further comparision, Step 119. If the dealer determines that there are successive hands remaining, then the play returns to Step 117, and continues to compare as to remaining successive players, as shown by line 120. If there is no successive hand remain at Step 119, then play ends, Step 121, the play then return to the start, shown in Step 122, a new game begins.

Figure 8:
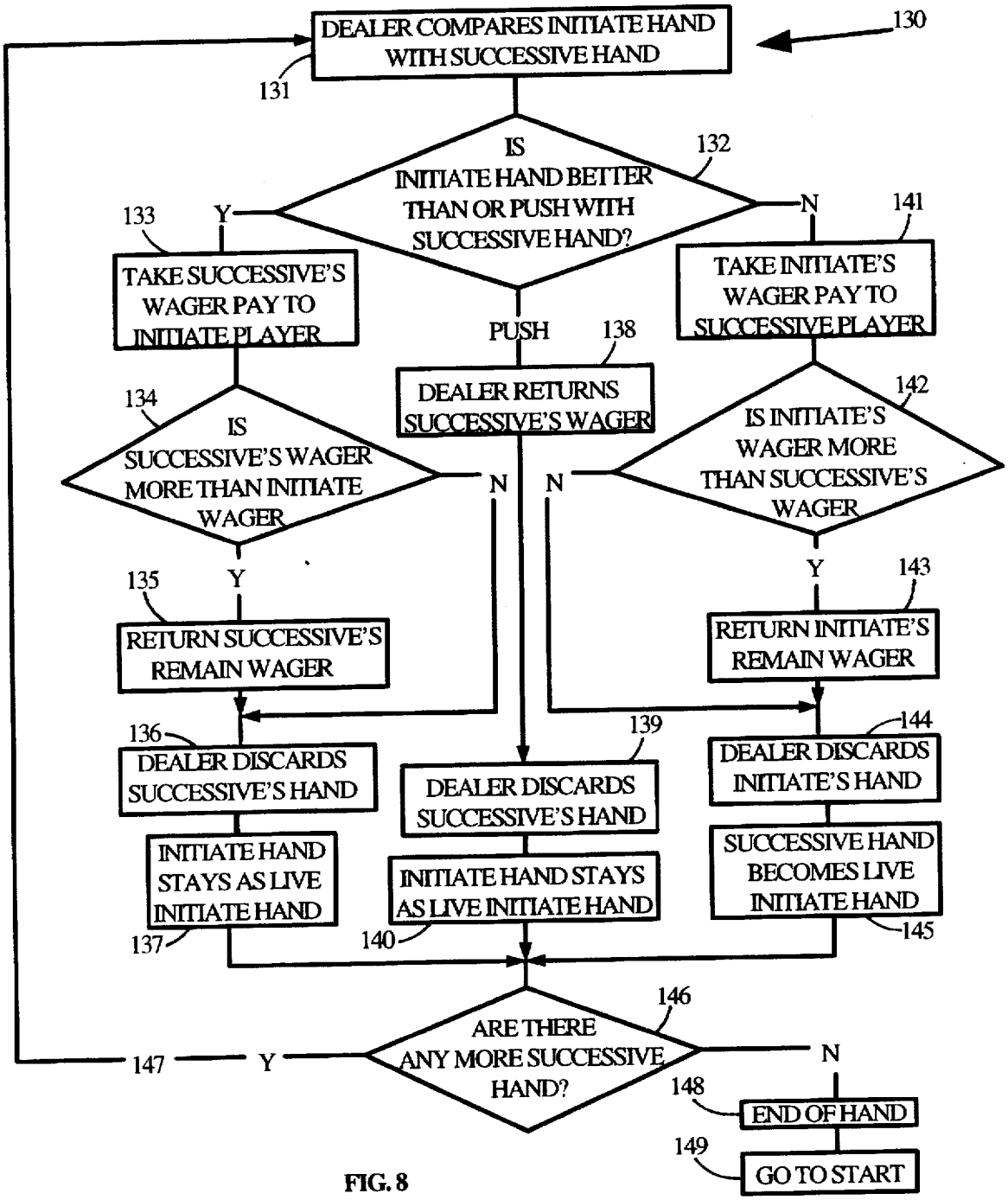
FIG. 8 show a flow chart the depicts in more detail of different possible pay-off outcome of the Step 117 (FIG. 7).

FIG. 8, show a flow chart 130 starting with Step 131, which is equivalent to Step 117 in FIG. 7, omitting earlier steps, depicting the pay-off in more detail of different possible outcome of the hands. There are only three possible outcome in the game, in which the dealer has to determine; win, lose, or push, Step 132. If the initiative hand is better (win) than the successive hand, then the dealer will collect from successive player up to the amount of the winning wager of initiative player and such amount is given to the initiating player, Step 133. If the dealer determines that successive player's wager is more than initiate player's wager, Step 134, then dealer returns remain successive's wager to the successive player, Step 135, and the successive player's hand need to be discarded in Step 136. By discarding the successive player's hand, the winning initiate hand will remain as live initiate hand, Step 137. Then the dealer determines if there is any other successive hand, for further comparision, Step 146. If there is a remaining successive hand, then the play returns to Step 131, as shown by line 147, for further comparison. If there is no remaining successive hand, Step 146. Then the game ends, Step 148, the play returns to start, Step 149, for a new game beginning at Step 111 (FIG. 7).

Returning to Step 132 (FIG. 8). If the dealer determines that there is a push between initiate hand and successive hand, Step 132, then the dealer returns successive's wager in full amount to successive player, Step 138. The successive player's hand need to be discarded, Step 139. By discarding successive player's hand the initiate hand will remain as live initiate hand, Step 140. The dealer then determines, if there is any other successive hand for further comparision, Step 146. If there is a remaining successive hand, then the play returns to Step 131, as shown by line 147, for further comparison. If there is no remaining successive hand, Step 146, the game ends, Step 148, and the play returns to start, Step 149, for a new game beginning at Step 111 (FIG. 7).

Returning to Step 132 (FIG. 8). If the dealer determines that the successive hand is better (win) than the initiate hand, then the dealer will collect from the initiate player the amount up to the amount of the winning wager of successive player and such amount is given to the successive player, Step 142. If the dealer determines that initiate player's wager is more than successive player, Step 142, then dealer returns remaining of initiate wager to the initiate player, Step 143, and the initiate player's hand need to be discarded, Step 144. By discarding the initiate player's hand the winning successive player's hand, will then become live initiate hand, Step 145. The dealer determines if there is any more successive hand for further comparision, Step 146. If there is a remaining successive hand, the play then return to Step 131, as shown by line 147, for further comparison. If there is no remaining successive hand, Step 146, the game ends, Step 148, and the play returns to start, Step 149, for a new game beginning at Step 111 (FIG. 7).

I claim:

1. A method for conducting a non-banking game between two or more individual players using gambling devices of the type wherein different collections of such devices are ranked by the rules of such game as to winning or losing and wherein the respective players place wagers and the respective players win or lose according to the ranking of their respective collections of gambling devices comprising the Steps of:

(A) distributing gambling devices to each of the respective players in accordance with the rules of such game each player placing a wager of any amount desired, wherein the amount wagered by each player may be different;

(B) determining the winning and losing players in accordance with the ranking of the respective collections of gambling devices of the respective players;

(C) taking from each losing player an amount of such player's wager that equals the lesser of:

(i) amount wagered by the winning player, and (ii) the amount wagered by such losing player wherein if the amount wagered by the winning player is less than the amount wagered by a losing player, then the losing player having a remaining losing wager amount; and (D) giving to the winning player the amounts taken from the losing players;

(E) returning any remaining losing wagers to the respective losing after the pay-off is completed.

2. The method of claim 1 further comprising the Steps of:

(F) eliminating the winning player determined in Step (B) from further play;

(G) determining the winning and losing players in accordance with the ranking of the respective collections of gambling devices of the respective remaining players;

(H) taking from each losing player determined in Step (G) an amount equal to the lesser of:

(i) the amount of wager remaining after Step (D) of the winning player, and (ii) the amount of the wager remaining after Step (D) of such losing player; and (I) giving to the winning player all of the amounts taken from the losing players.

3. The method of claim 2 future comprising the Steps of:

(J) eliminating the winning player determined in Step (G) from further play;

(K) determining the winning and losing players in accordance with the ranking of the respective collections of gambling devices of the respective remaining players;

(L) taking from each losing player determined in Step (K) an amount equal to the lesser of:

(i) the amount of wager remaining after Step (I) of the winning player, and (ii) the amount of the wager remaining after Step (I) of such losing player; and (M) giving to the winning player the amounts taken from the losing players;

(N) repeating said Step (D) as long as losing wagers remain.

4. The method of claim 3 further comprising the Step of:

(O) dividing the amounts taken from the losing players in Step (D) among two or more tie hand winners;

(P) calculating the pay-off in Step (D) that the winners' wagered are not in the same amount.

5. The method of claim 4 further comprising the Step of:

(Q) counting the least winning wager in Step (P);

(R) subtracting the higher winning wager from the least winning wager in Step (P);

(R) repeating said in Step (P) as long as losing wager remain.

6. A method for conducting a non-banking game between two or more individual players using gambling devices of the type wherein different collections of such devices are ranked by the rules of such game as to winning or losing and wherein the respective players place wagers and the respective players win or lose according to the ranking of their respective collections of gambling devices comprising the Steps of:

(A) distributing gambling devices to each of the respective players in accordance with the rules of such game each player placing a wager of any amount desired, wherein the amount wagered by each player may be different;

(B) assigning each player a successive order of play in a designated sequence of play regardless of the amounts each player wagered, with rules of such game;

(C) designating one of the players as the first initiating player with rules of such game;

(D) determining the winning and losing players, as between initiate player and successive players in the designated sequence regardless of the amounts each player wagered in accordance with the ranking of the respective collections of gambling devices of such players until of one such successive players is determined to have a winning collection of gambling devices with respect such collection of gambling devices of the initiate player;

(E) taking from losing player an amount of such player's wager that equals the lesser of:

(i) amount wagered by the winning player, and (ii) the amount wagered by such losing player wherein if the amount wagered by the winning player is less than the amount wagered by a losing player, then the losing player having a remaining losing wager amount; and (F) giving to the winning player the amount taken from the losing players;

(G) returning successive player's wager in results of a tie between the initiate player and the successive player;

(H) initiate player staying as a live initiate player;

(I) if the winning player is the successive player, the successive player becoming live initiate player;

(J) repeating Steps (D)–(I) until all successive players have participated.

7. The method of claim 6 further comprising the Steps of:

(K) taking from the initiate player an amount equal to the lesser of:

(i) the amount wagered by the player determined in Step (D) to have a winning collection of gambling devices with respect to such collection of gambling devices of the initiate player; and (ii) the amount wagered by the initiate player; and (L) giving the amount determined in Step (K) to the player determined in Step (D) to have a winning collection of gambling devices with respect to such collection of gambling devices of the initiate player.

8. The method of claim 6 further comprising the Step of:

(M) taking from the successive player an amount equal to the lesser of:

(i) the amount wagered by the player determined in Step (D) to have a winning collection of gambling devices with respect to such collection of gambling devices of the successive player, and (ii) the amount wagered by the initiate player; and (N) giving the amount determined in Step (M) to the player determined in Step (D) to have a winning collection of gambling devices with respect to such collection of gambling devices of the successive player.

9. The method of claim 6 further comprising the Steps of:

(O) eliminating the initiate player from further play;

(P) designating successive player as initiate player determined in Step (D) to have a winning collection of gambling devices with respect to such collection of gambling devices of the initiate player;

(Q) determining the winning and losing as between initiate player and successive players in the designated sequence in accordance with the ranking of the respective collections of gambling devices of such players until of one such successive players is determined to have a better collection of gambling devices than the initiate player;

(R) taking wager from losing player determined in Step (Q) an amount equal to the lesser of:

(i) the amount wagered by the winning player, and (ii) the amount wagered by such losing player; and (S) giving to the winning player amount determined in Step (R) from the losing player.

10. The method of claim 6 further comprising the Steps of:

(T) eliminating the successive player from further play;

(U) initiate player staying as initiate player determined in Step (D) to have a winning collection of gambling devices with respect to such collection of gambling devices of the initiate player;

(V) taking wager from losing player determined in Step (D) an amount equal to the lesser of:

(i) the amount wagered by the winning player, and (ii) the amount wagered by such losing player; and (W) giving to the winning player amount determined in Step (V) from the losing player.

11. The method of claim 6 further comprising the Steps of:

(X) returning successive player's wager determined in Step (D) that have a higher losing wager with respect to initiate player's wager;

(Y) returning initiate player's wager determined in Step (D) that have a higher losing wager with respect to successive player's wager.

* * * * *